US007544933B2

(12) United States Patent
Cooks et al.

(10) Patent No.: US 7,544,933 B2
(45) Date of Patent: Jun. 9, 2009

(54) METHOD AND SYSTEM FOR DESORPTION ATMOSPHERIC PRESSURE CHEMICAL IONIZATION

(75) Inventors: Robert G. Cooks, West Lafayette, IN (US); Bogdan Gologan, Hoboken, NJ (US); Zoltán Takáts, Budapest (HU); Justin M. Wiseman, Avon, IN (US); Ismael Cotte-Rodriguez, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 257 days.

(21) Appl. No.: 11/653,569

(22) Filed: Jan. 16, 2007

(65) Prior Publication Data

US 2007/0187589 A1 Aug. 16, 2007

Related U.S. Application Data

(60) Provisional application No. 60/759,468, filed on Jan. 17, 2006.

(51) Int. Cl.
*H01J 49/00* (2006.01)

(52) U.S. Cl. ..... 250/288; 250/281; 250/282; 250/425; 250/423 R

(58) Field of Classification Search ..... 250/288, 250/282, 425, 281, 424, 423 R
See application file for complete search history.

(56) References Cited

U.S. PATENT DOCUMENTS 5,580,434 A 12/1996 Robotti et al.

FOREIGN PATENT DOCUMENTS

JP WO 2005/104181 * 3/2005

(Continued)

OTHER PUBLICATIONS

Takats et al. "Mass Spectrometry Sampling Under ambient Conditions with Desorption Electrospray Ionization", Science, Oct. 15, 2004, vol. 306, pp. 471-473.*

*Primary Examiner*—Jack I Berman
*Assistant Examiner*—Nicole Ippolito Rausch
(74) *Attorney, Agent, or Firm*—Sonia K. Guterman; Lawson & Weitzen, LLP

(57) ABSTRACT

A desorption atmospheric pressure chemical ionization (DAPCI) system delivers a primary ion beam composed of an inert, high velocity gas and solvent ions to a surface to effect desorption and ionization of both volatile and non-volatile species present on surfaces. A electrode having a tapered tip is connected to a high voltage power supply. The tapered tip projects outward from a capillary carrying a high-speed flow of gas. A vapor of a solvent is mixed into the annular gas flow surrounding the needle. The gaseous solvent vapor is ionized in close proximity to the tapered tip by virtue of the high voltage applied to the electrode. The high-speed flow of gas and solvent vapor ions extending outward from the capillary is directed toward a substrate on which an analyte of interest may have been deposited. The solvent vapor ions can blanket the surface of the analyte causing a static charge build up that facilitates ion desorption and additionally can provide positive ion adducts of the analyte freed from the substrate surface that can be directed toward an atmospheric intake of a mass spectrometer or other instrument capable of studying the analyte.

(Continued)

20 Claims, 5 Drawing Sheets

U.S. PATENT DOCUMENTS

| | | | | |
|---|---|---|---|---|
| 6,787,313 | B2 | 9/2004 | Morozov et al. | |
| 6,818,394 | B1 | 11/2004 | O'Donnell-Maloney et al. | |
| 6,881,588 | B2 | 4/2005 | Tegeler et al. | |
| 6,911,182 | B2 | 6/2005 | Tegeler et al. | |
| 6,949,741 | B2 | 9/2005 | Cody et al. | |
| 7,015,465 | B2 | 3/2006 | Karol et al. | |
| 2002/0092366 | A1 | 7/2002 | Brock et al. | |
| 2003/0228240 | A1* | 12/2003 | Dwyer | 422/99 |
| 2004/0023410 | A1 | 2/2004 | Stacey | |
| 2004/0203175 | A1 | 10/2004 | Li et al. | |
| 2005/0029442 | A1* | 2/2005 | Takats et al. | 250/281 |
| 2005/0230635 | A1* | 10/2005 | Takats et al. | 250/424 |
| 2005/0242039 | A1* | 11/2005 | Wall | 210/656 |
| 2006/0054805 | A1* | 3/2006 | Flanagan et al. | 250/288 |
| 2006/0131497 | A1* | 6/2006 | Yang et al. | 250/288 |
| 2006/0192107 | A1 | 8/2006 | DeVoe et al. | |
| 2006/0273254 | A1 | 12/2006 | Berkout et al. | |
| 2006/0289747 | A1* | 12/2006 | Schultz et al. | 250/294 |
| 2007/0114386 | A1* | 5/2007 | Fischer et al. | 250/288 |
| 2008/0054176 | A1* | 3/2008 | Hiraoka | 250/288 |
| 2008/0135746 | A1* | 6/2008 | Wildgoose et al. | 250/283 |

FOREIGN PATENT DOCUMENTS

| | | | |
|---|---|---|---|
| WO | WO 2005/017936 | A2 | 2/2005 |

* cited by examiner

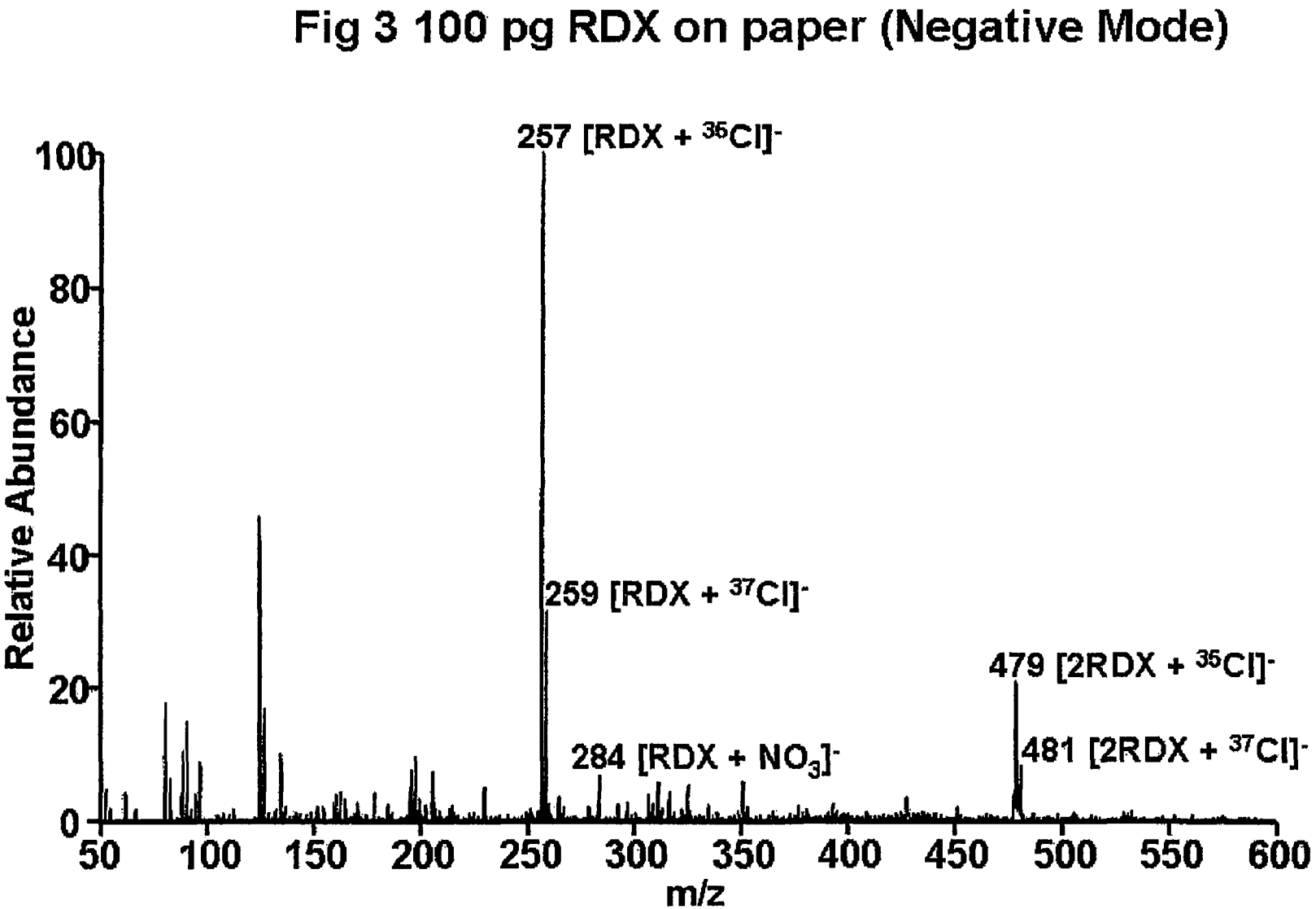
Fig 3 100 pg RDX on paper (Negative Mode)
257 [RDX + 35Cl]-
259 [RDX + 37Cl]-
284 [RDX + NO3]-
479 [2RDX + 35Cl]-
481 [2RDX + 37Cl]-
Relative Abundance
m/z
0
20
40
60
80
100
50
100
150
200
250
300
350
400
450
500
550
600

Fig 4 100 pg RDX on paper using toluene as solvent in positive ion mode
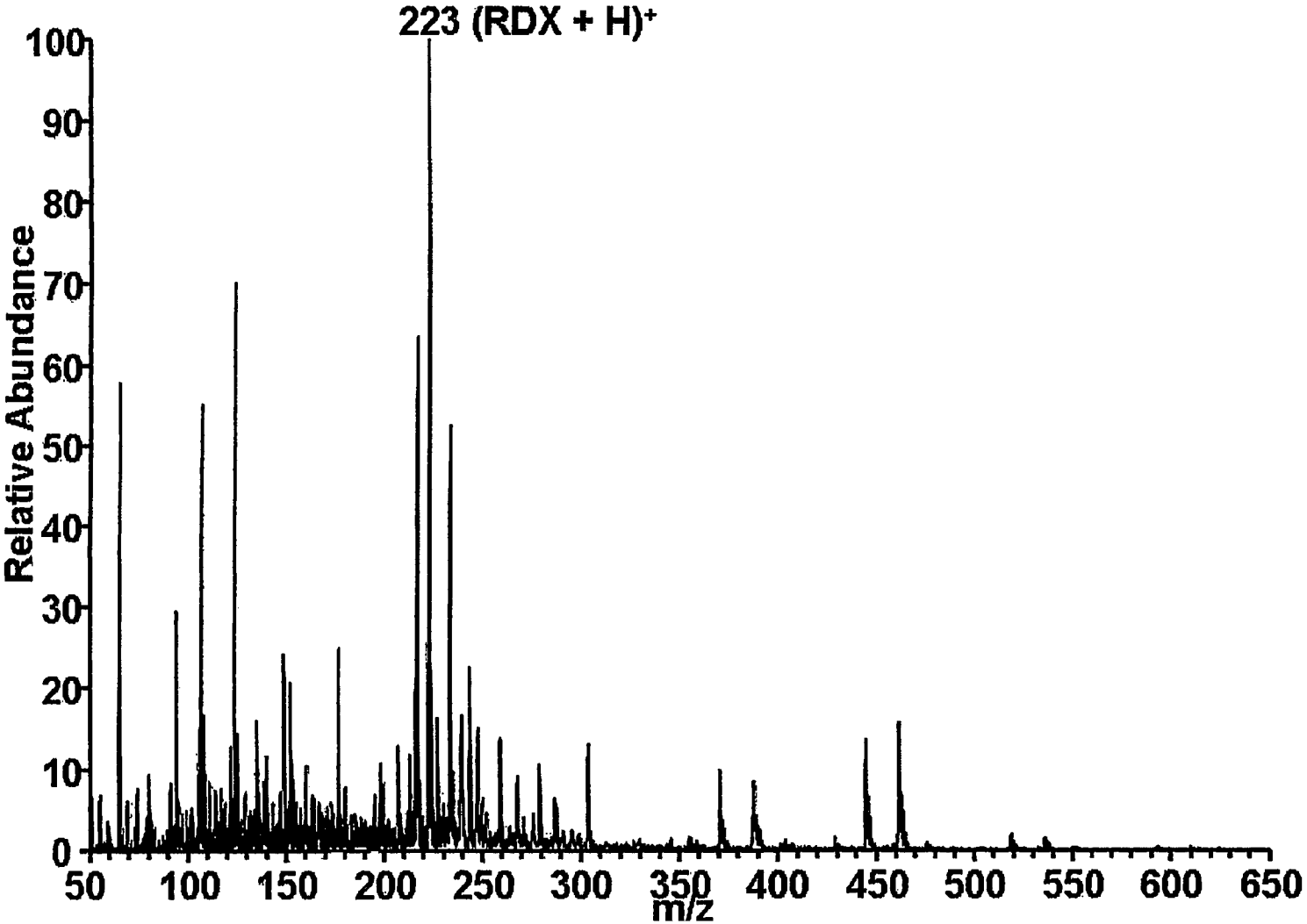

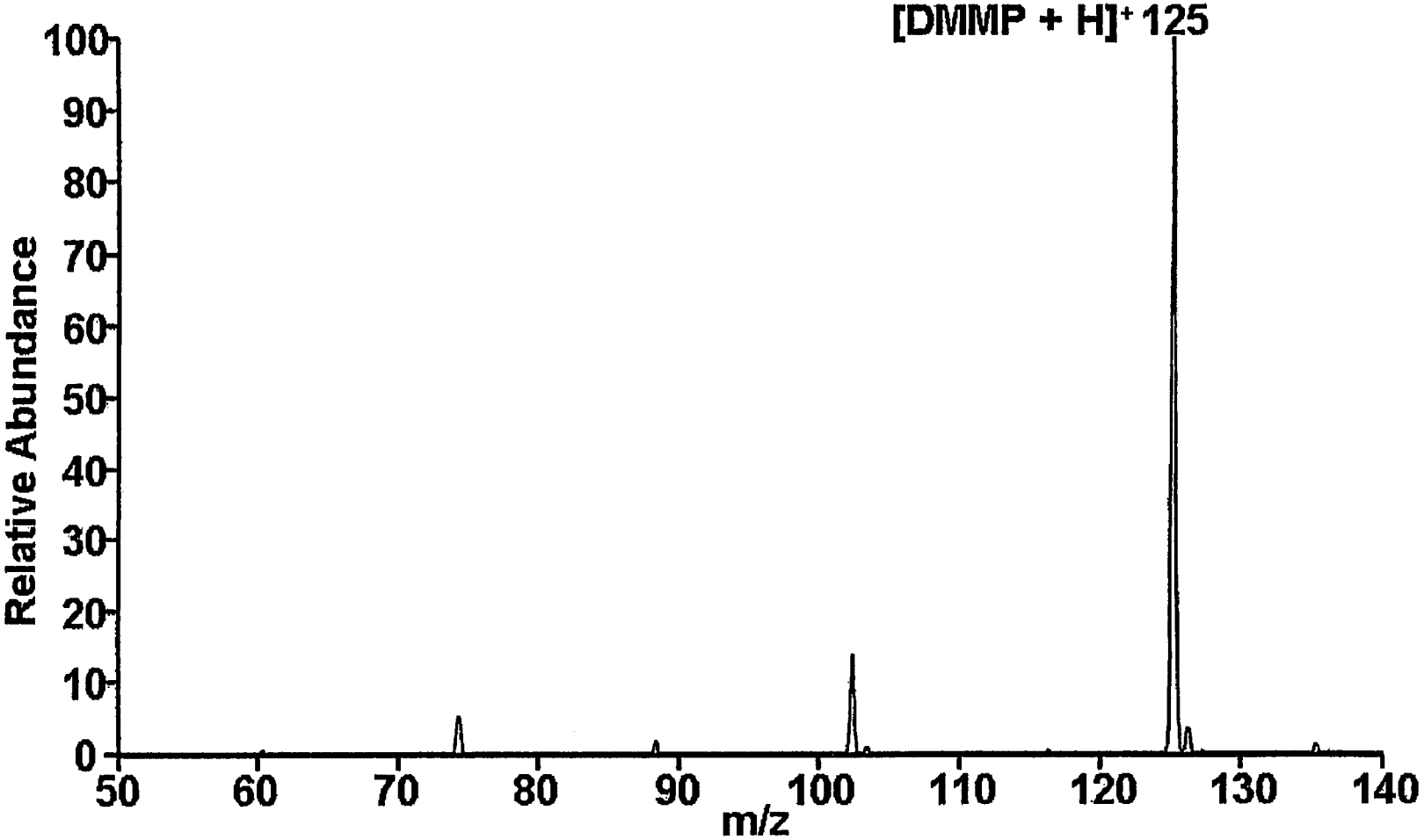
Fig 5 10 ng DMMP on paper using methanol/water as solvent in positive ion mode

METHOD AND SYSTEM FOR DESORPTION ATMOSPHERIC PRESSURE CHEMICAL IONIZATION

CROSS-REFERENCE TO RELATED APPLICATIONS

This application is related to and claims all benefit of U.S. Provisional Application Ser. No. 60/759,468 filed Jan. 17, 2006.

TECHNICAL FIELD

This invention relates to atmospheric ionization and desorption of analytes situated on a substrate by a gas jet containing gaseous ions of solvents that can interact with the analytes.

BACKGROUND OF THE INVENTION

The detection of explosives, chemical warfare (CW) agents, biological toxins, and other organic molecules that might affect public safety or the environment is a subject of continuing strong interest in analytical chemistry, driven by threats to civil society and by environmental problems associated with explosives residues and by-products. The requirements of an ideal method include (i) high sensitivity, (ii) applicability to involatile and thermally unstable analytes, (iii) high specificity to minimize the chance of false positives or false negatives, (iv) rapid response times, and (v) no sample preparation or handling.

Ion mobility spectrometry (IMS) has been a common choice for addressing this problem. IMS has the advantage of high sensitivity and speed, but suffers in terms of the other criteria. Mass spectrometry (MS) is widely considered to have the best specificity of any technique applicable to the broad class of explosive, toxic and other compounds, and it is highly sensitive, but mass spectrometry has generally required significant sample manipulation. Another barrier to the use of mass spectrometry is that some of the analytes of interest such as some explosives are non-volatile compounds which are not easily ionized by traditional methods. Although a wide variety of desorption ionization methods is available for the MS analysis of compounds on surfaces, they generally require operation under vacuum conditions. Since traditional desorption ionization methods fail at in-situ explosives detection, the approach usually pursued involves wiping the ambient surface with a special material wipe followed by thermal desorption/gas phase ionization of any compounds picked up from the surface by the wipe. Although this dry sampling/thermal method is widely employed in airport explosive detection systems, it requires manual sample transfer, is relatively slow, and is not ideal for the detection of thermally labile explosives or explosives which have low vapor pressures.

Furthermore, the requirement for sample manipulation is also a disadvantage of solution phase mass spectrometry methods of analysis based on electrospray ionization such as that disclosed in the International Publication Number WO 2005/017936. This is unfortunate because most explosives show high affinities for various anions and can be ionized directly by electrospray ionization or by anion attachment, typically using anions generated by an electrospray. The high electron affinities associated with the nitro- or nitrate functional groups present in the overwhelming majority of explosives in common use means that they readily form negative ions by electron capture. Various electron sources including corona discharge, glow discharge and 63Ni beta emitters have been successfully implemented as ion sources for explosive detection, including the direct detection of explosives in air. An ion source of particular interest is disclosed in U.S. Pat. No. 6,949,741, which exposes a sample to a stream of metastable neutral excited-state species of a carrier gas to form analyte ions. The recently developed DESI method, disclosed in United States Application Publication No. 2005/0230635, is performed by directing a pneumatically-assisted electrospray onto a surface bearing an analyte and collecting the secondary ions generated by the interaction of the charged microdroplets from the electrospray with the neutral molecules of the analyte present on the surface. The ionization of analyte can be either positive or negative depending on the polarity of the high voltage source and the susceptibility of the analyte to the particular reaction process involved. An alternate mechanism can occur with DESI, namely, the impact of electro-sprayed droplets on the surface, dissolution of the analyte in the droplet, and subsequent evaporation by mechanisms well know from ESI. While this is generally viewed as a positive feature, there arise situations where one would like to preclude all but a single ionization process mechanism.

What is needed is a system that provides for a single ionization process mechanism so that the analysis of the analyte interaction with various ions can be studied. Such a single ionization process would desirably allow for fast screening of substrate surfaces for trace quantities of analytes such as explosives, CW agents, biological toxins, and other contraband materials. Such a single ionization process could also find utility in quality control, environmental analysis, food safety, and other areas of commercial interest.

SUMMARY OF THE INVENTION

The foregoing needs are solved by a system of desorption atmospheric pressure chemical ionization (DAPCI) in which a wire, needle, or other elongated electrode having a tip, which can be tapered, is connected to a high voltage power supply. The tip projects outward from a capillary carrying a high-speed flow of gas. A vapor of a solvent is mixed into the annular gas flow surrounding the electrode. The gaseous solvent vapor is ionized in close proximity to the tip by virtue of the high voltage applied to the electrode. The high-speed flow of gas and solvent vapor ions extending outward from the capillary is directed toward a substrate on which an analyte of interest may be present.

The electrode can be formed of stainless steel or other metal selected to minimally interact with the surrounding flow of gas and solvent vapor. The gas can be a neutral or inert gas such as $N_2$ or He. The solvent can be selected to desirably interact with the analyte of interest. For example, the solvent can be an aromatic compound such as toluene or xylene, an alcohol such as methanol or ethanol, an oxyacid such as acetic acid, trifluoroacetic acid, or a chloride ion source such as dichloromethane. The solvent is in a vapor phase so that no droplets of the solvent are present in the gas flow. The voltage applied to the electrode can be between about 3 to 6 kilovolts so as to produce a corona discharge in close proximity to the tip of the electrode. When coupled to a mass spectrometer, the system provides for high sensitivity, applicability to non-volatile and thermally unstable analytes, high specificity to minimize the chance of false positives or negatives, rapid response times, and no sample preparation or handling.

A better understanding of the present invention will now be gained upon reference to the following detailed description that, when read in conjunction with the accompanying drawings and graphs, depicts the structure and operation.

BRIEF DESCRIPTION OF THE DRAWINGS

FIG. 3 is a graph showing the relative abundances of the ionic species formed when gaseous ions derived from a methanol/water/hydrogen chloride (100:100:0.1) mixture, are directed toward an analyte sample including RDX on a paper substrate.

FIG. 4 is a graph showing the relative abundances of the ionic species formed when nitrogen gas saturated with toluene vapor is ionized and directed in the form of a gas jet by the nozzle shown in FIG. 1, toward an analyte sample including RDX on paper.

FIG. 5 is a graph showing the relative abundances of the ionic species formed when gaseous methanol/water ions are directed in the form of a gas jet by the nozzle shown in FIG. 1 toward an analyte sample including DMMP on paper.

DETAILED DESCRIPTION

Figure 1:
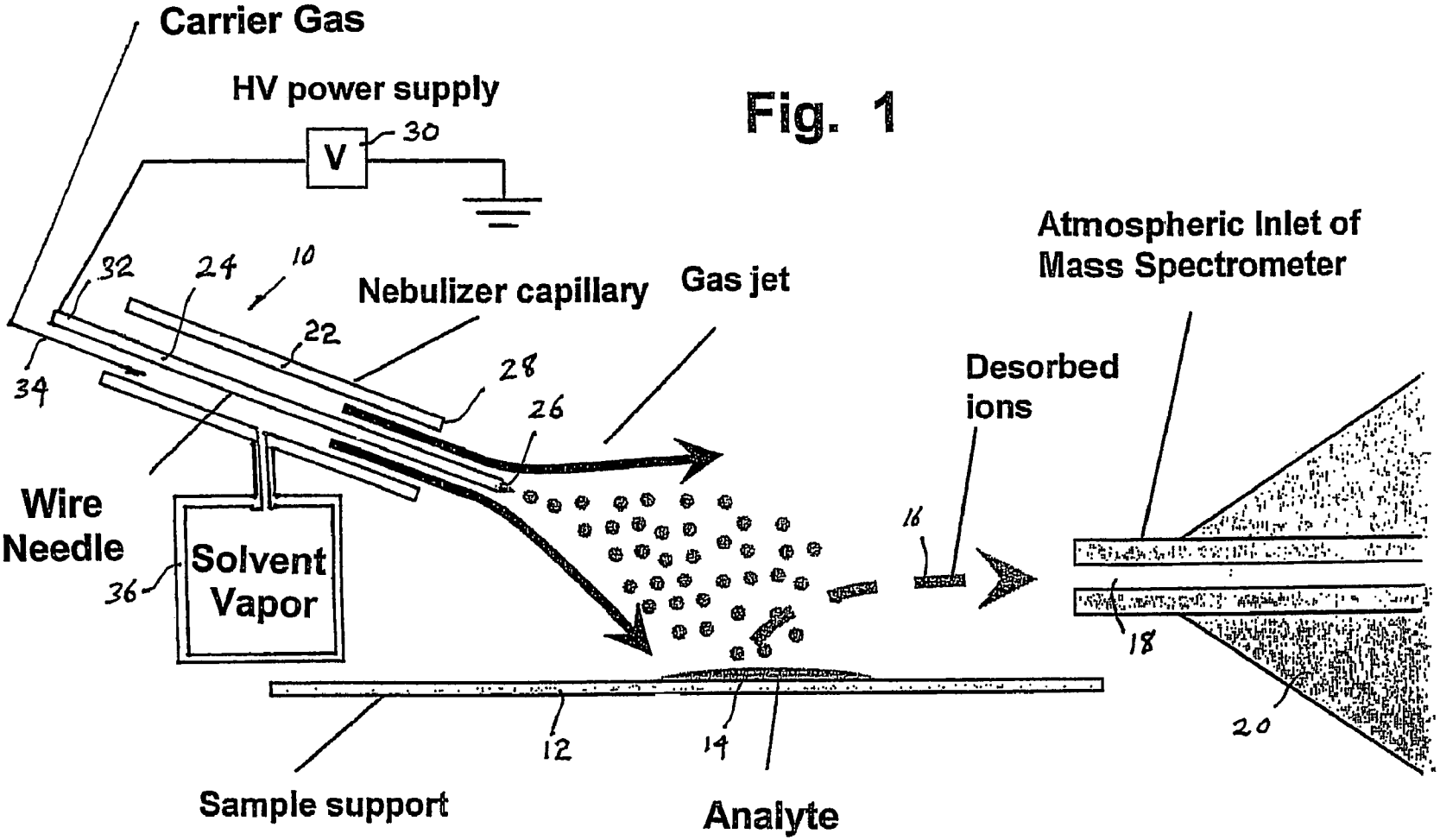
FIG. 1 is a schematic view of a system for desorption atmospheric pressure chemical ionization according to the present invention.

A desorption atmospheric pressure chemical ionization system is shown in FIG. 1 to include a DAPCI nozzle 10 directed toward a sample support 12 on which an analyte 14 may be situated. The sample support can be clothing, luggage, plants, skin, etc., and for non-living supports, the support can be heated to aid the process. Desorbed ions 16 of the analyte 14 can be directed or attracted to an atmospheric inlet 18 of a mass spectrometer, ion mobility spectrometer or other instrument 20 capable of discerning the chemical or biological composition of the desorbed ions. The inlet 18 can be situated adjacent to, or spaced considerably from, the sample support 12.

The DAPCI nozzle 10 includes a capillary 22 having a wire, needle or other elongated electrode 24 generally coaxially aligned within the capillary 22. The electrode 24 can have a tapered tip 26 that projects from an outlet end 28 of the capillary 22. A high voltage power supply 30 is coupled to a portion 32 of the electrode 24 that is remote from the tip 26. A source 34 of a pressurized carrier gas is coupled to the capillary 22 to supply the gas in a volume sufficient to cause an annular flow of the gas through the capillary 22 around the electrode 24 and outward from the outlet end 28. A source 36 of a gaseous solvent vapor can be coupled to the capillary 22 to supply a defined quantity of the vapor to the flow of carrier gas. The combined flow of the carrier gas and gaseous solvent vapor provides a gas jet that can be directed toward the sample support 12 on which an analyte 14 may be situated.

The capillary 22 can have an inside diameter of between about 0.1 and 1.0 mm, but it is preferred that the inside diameter be between about 0.15 and 0.35 mm. Capillaries having inside diameters of 0.18 mm and 0.25 mm have been found to perform satisfactorily. The capillary 22 can have any length suitable to the remainder of the nozzle 10. The electrode 24 can take the form of a tapered stainless steel wire of about 0.1 mm in diameter. The length of the electrode 24 should be sufficient to permit portion 32 to be easily coupled to the high voltage power supply 30 and at the same time permit the tip 26 to project from about 1 to 5 mm beyond the outlet end 28 of the capillary 22.

The carrier gas can be an essentially neutral gas such as $N_2$ or He supplied at a controlled pressure. The carrier gas can be a single un-doped gas or vapor, i.e. not a mixture. The carrier gas can also be air. It will be appreciated that the pressure differential between the source 34 and the outlet 28 in relation to the cross-sectional area of the capillary 22 not occupied by the electrode 24 will essentially determine the velocity of the annular flow of carrier gas through the capillary 22. By providing sufficient pressure differential and nozzle geometry, the velocity of the carrier gas can be supersonic.

The power supply 30 is desirably one capable of delivering a high voltage of at least from 3 to 6 kV, which will ionize the gaseous solvent vapors as they travel in close proximity past the tip 26 of the electrode 24 by corona discharge ionization. The solvent vapor ions so formed are then carried by the neutral carrier gas jet into contact with that analyte 14 situated on the sample support 12 where the solvent vapor ions can ionize molecules of the analyte 14 by charge transfer (typically either electron or proton). This charge transfer can cause a desorption of the analyte ions from the surface of the sample support 12 in a type of chemical sputtering that may be facilitated by any static charge accumulation on the sample support surface. The desorbed analyte ions can be directed by the gas jet rebounding from the sample support surface toward an atmospheric intake of a mass spectrometer, ion mobility spectrometer, or other instrument capable of studying the analyte. The solvent vapor ions can blanket the surface of the analyte causing a static charge build up that facilitates ion desorption and additionally can provide positive ion adducts of the analyte freed from the substrate surface that can be directed toward the atmospheric intake. The intake, or fixtures adjacent to the intake, can be suitably charged by the power supply 30 or other means to further attract the ionized molecules of the analyte.

By way of example, a DAPCI nozzle 10 as previously described was supplied with $N_2$ in a volume sufficient to generate a near sonic gas jet. A reagent vapor was introduced through T-junction source 36 into the high velocity gas jet traveling through a fused silica capillary 22 within the DAPCI nozzle 10. A voltage of 2 kV or more was applied to the electrode 24 so that the reagent vapor was ionized as it exited the nozzle. The nozzle was directed toward a number of samples and the rebounding gas flow was collected at an atmospheric intake of a mass spectrometer. Ionization of cholesterol, carotene, coronene and other compounds using protonated methanol reagent ions, leads to results identical to those recorded for these analytes by conventional DESI.

Figure 2:
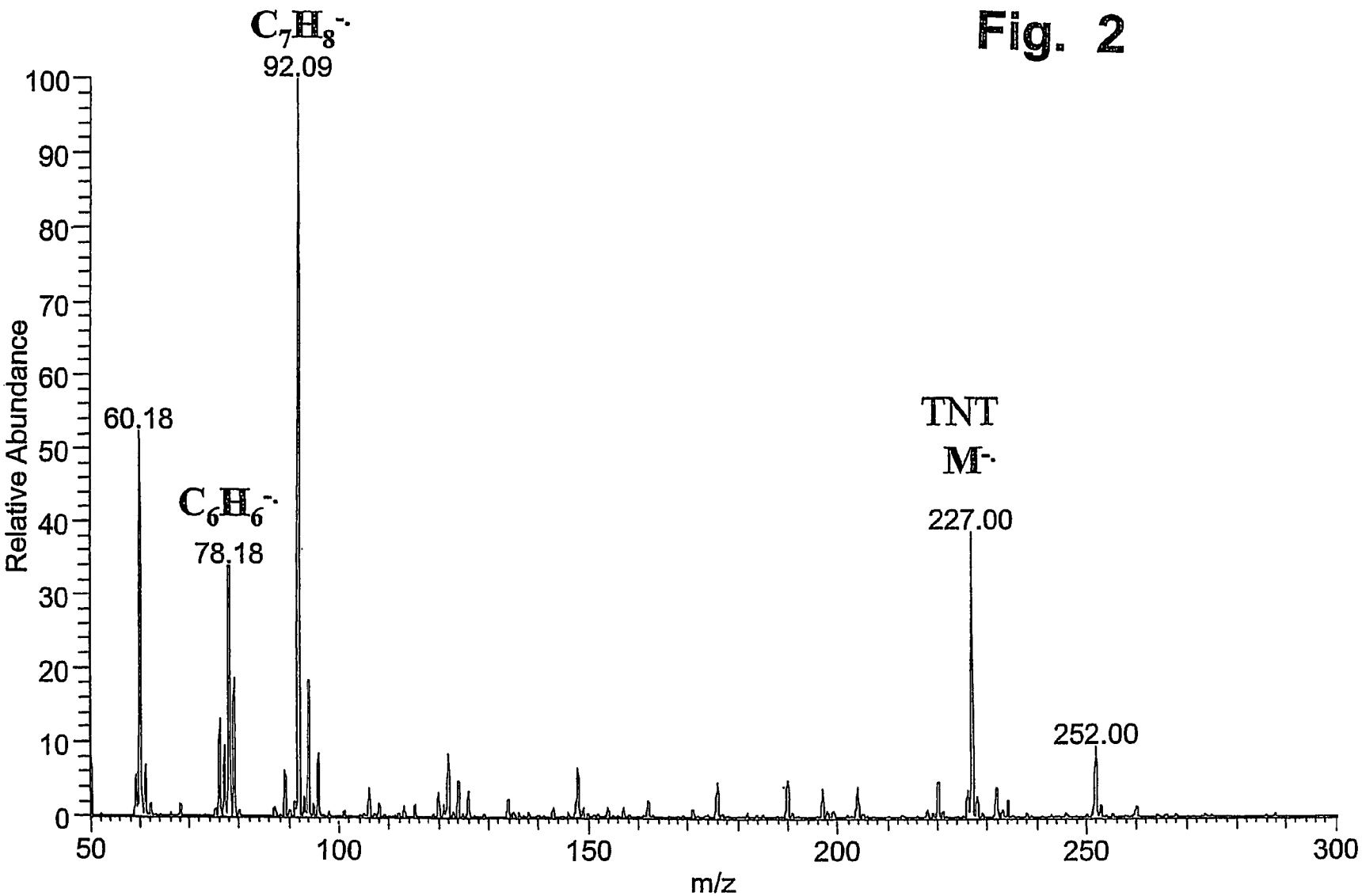
FIG. 2 is a graph showing the relative species abundance when gaseous vapor toluene anions, formed in the gas jet by the nozzle shown in FIG. 1, are directed toward an analyte sample including TNT on paper.

In the negative ion mode, when using toluene anions as reagents, TNT readily undergoes ionization as shown in FIG. 2. The TNT signal intensity was highly dependent on the high voltage applied to the electrode of the electrospray source, strongly implicating the corona discharge as the primary source of electrons for the electron capture ionization. The spectrum shows that the species responsible for carrying the electrons was identified in this case. As expected, TNT was not observed to form positive ions in conventional DESI ionization, since its proton affinity is considerably lower than that of methanol.

FIG. 3 shows showing the relative abundances of the ionic species formed when gaseous ions derived from a methanol/water/hydrogen chloride (100:100:0.1) mixture, are directed toward an analyte sample including RDX on a paper substrate. The total amount of RDX on the surface was 100 pg and a source voltage of 3 kV was applied to the stainless steel needle shown in FIG. 1.

FIG. 4 shows the relative abundances of the ionic species formed when nitrogen gas saturated with toluene vapor is ionized and directed in the form of a gas jet by the nozzle shown in FIG. 1, toward an analyte sample including RDX on paper. The amount concentration of RDX on paper was 100 pg and a source voltage of 4 kV was applied to the electrode shown in FIG. 1.

FIG. 5 shows the relative abundances of the ionic species formed when gaseous methanol/water ions are directed in the form of a gas jet by the nozzle shown in FIG. 1 toward an analyte sample including DMMP on paper. The total amount of DMMP on paper was 10 ng and a source voltage of 5 kV was applied to the electrode shown in FIG. 1.

These results are believed to indicate that in most cases ionization follows a mechanism in which reagent ions are formed in the corona discharge and these reagent ions ionize the analyte molecules by either electron or proton transfer in a thermochemically-controlled chemical ionization step. The reagent ions can blanket the surface causing static charge build-up which facilitates ion desorption and transport towards the mass spectrometer, ion mobility spectrometer, or other instrument capable of studying the analyte.

It is thus seen that the present invention has utility in a variety of situations, and that variations and modifications of the present invention additional to the embodiments described herein are within the spirit of the invention and the scope of the claims.

We claim:

1. A nozzle for directing a high-speed gas jet at an analyte on a sample support spaced from the nozzle, the nozzle comprising:

a capillary having a first end and a second end, the first end being coupled to a source of carrier gas providing a gas jet flow from the first end out the second end for directing toward the analyte on the sample support, an elongated electrode situated generally coaxially within the capillary having a first end coupled to a high voltage power supply and a second end protruding from the second end of the capillary, and a vapor source coupled to the capillary between the first and second ends for supplying a gaseous solvent vapor to the flow of carrier gas.

2. The nozzle of claim 1 wherein the capillary has an inside diameter of between about 0.1 and 1.0 mm.

3. The nozzle of claim 1 wherein the elongated electrode includes a tapered end that protrudes from the capillary second end by a distance of between about 1 and 5 mm.

4. A system for detecting an analyte situated on a sample support, the system comprising:

an atmospheric inlet of an instrument capable of discerning the composition of molecules entering the inlet, the inlet being spaced from the sample support, and a nozzle directed toward the analyte on the sample support and toward the inlet, the nozzle being spaced from the sample support, the nozzle including a capillary having a first end and a second end, the first end being coupled to a source of carrier gas providing a gas jet flow from the first end out the second end, an elongated electrode situated generally coaxially within the capillary having a first end coupled to a high voltage power supply and a second end protruding from the second end of the capillary, and a vapor source coupled to the capillary between the first and second ends for supplying a gaseous solvent vapor to the flow of carrier gas.

5. The system of claim 4, wherein the instrument capable of discerning the composition of the molecules entering the inlet comprises a mass spectrometer.

6. The system of claim 4, wherein the instrument capable of discerning the composition of the molecules entering the inlet comprises an ion mobility spectrometer.

7. The system of claim 4, wherein the source of carrier gas comprises a neutral gas source providing a high-speed flow of the gas out of the capillary second end.

8. The system of claim 4, wherein the source of cater gas comprises an ambient air source providing a high-speed flow of the gas out of the capillary second end.

9. The system of claim 7 or 8, wherein the source of carrier gas is sufficient to provide a near sonic flow of the gas out of the capillary second end.

10. The system of claim 4, wherein the sample support is heated.

11. The system of claim 4, wherein the high voltage power supply comprises a direct current supply operated at between 3 and 6 kV.

12. The system of claim 11, wherein the polarity of the high voltage source applies a positive potential to the electrode to create positive ions of the analyte.

13. The system of claim 11, wherein the polarity of the high voltage source applies a negative potential to the electrode to create negative ions of the analyte.

14. The system of claim 4, wherein the vapor source contains an aromatic.

15. The system of claim 4, wherein the vapor source contains an alcohol.

16. The system of claim 4, wherein the vapor source contains an acid.

17. A method for detecting an analyte situated on a sample support, comprising the steps of:

positioning the sample support at a selected distance and orientation in relation to an inlet of an instrument capable of discerning the composition of molecules entering the inlet, directing a nozzle toward the analyte on the sample support, the nozzle being spaced from the sample support, wherein the nozzle has a capillary and an elongated electrode situated generally coaxially within the capillary within the nozzle, the electrode coupled to a high voltage power supply, the electrode having an end protruding from the nozzle, coupling a source of carrier gas to the nozzle to provide a gas jet flow of the carrier gas though the capillary out the nozzle toward the analyte, and supplying a selected quantity of a gaseous solvent vapor between a first end and a second end of the capillary to the flow of carrier gas, the gaseous solvent vapor being ionized by virtue of the high voltage applied to the electrode, the ionization being in close proximity to the electrode and prior to contact with the analyte.

18. The method of claim 17 further comprising the step of applying an electrical potential to said inlet to enhance the transport of analyte ions from the sample support to the inlet.

19. The method of claim 17 further comprising the step of heating the Sample support.

20. The method of claim 17 wherein the step of supplying the carrier gas further comprises sufficient quantity and pressure of the carrier gas to cause the gas jet flow out the nozzle to be of at least near sonic velocity.

* * * * *